US005535826A

United States Patent [19]

Brown et al.

[11] Patent Number: 5,535,826

[45] Date of Patent: Jul. 16, 1996

[54] WELL-HEAD STRUCTURES

[75] Inventors: Stuart C. Brown; James Crabb, both of Aberdeen, Scotland

[73] Assignee: Petroleum Engineering Services Limited, Dyce, Scotland

[21] Appl. No.: 200,402

[22] Filed: Feb. 23, 1994

[51] Int. Cl.[6] ..... E21B 34/04

[52] U.S. Cl. ..... 166/363; 166/368; 166/244.1

[58] Field of Search ..... 166/368, 363, 166/364, 325, 244.1, 297

[56] References Cited

U.S. PATENT DOCUMENTS

| | | | |
|---|---|---|---|
| Re. 27,464 | 8/1972 | Taylor, Jr. . | |
| 3,411,576 | 11/1968 | Taylor, Jr. | 166/363 X |
| 3,457,991 | 7/1969 | Sizer et al. . | |
| 3,796,257 | 3/1974 | Hudson | 166/363 |
| 3,866,676 | 2/1975 | Buans | 166/363 |
| 4,116,272 | 9/1978 | Barrington | 166/340 |
| 4,320,804 | 3/1982 | Brooks | 166/339 |
| 4,880,060 | 11/1989 | Schwenemann et al. | 166/336 |
| 4,934,871 | 6/1990 | Kazokas, Jr. | 405/224 |
| 5,050,680 | 9/1991 | Diehl et al. | 166/364 X |

FOREIGN PATENT DOCUMENTS

| | | |
|---|---|---|
| 1442563 | 7/1976 | United Kingdom . |
| 1574953 | 9/1980 | United Kingdom . |
| 2055133 | 2/1981 | United Kingdom . |
| 2097444 | 11/1982 | United Kingdom . |
| 2192921 | 1/1988 | United Kingdom . |

*Primary Examiner*—Terry Lee Melius

*Attorney, Agent, or Firm*—Popham, Haik, Schnobrich & Kaufman, Ltd.

[57] ABSTRACT

This invention relates to well-head structures, and particularly to so-called christmas trees, i.e. the complex of valves and pipes installed at a well-head to control the flow of high pressure oil or gas. The invention more particularly, but not exclusively relates to such structures for use in sub-sea structures. In order to accommodate all the required valves and pipes, known trees are normally undesirably high—i.e. of the order of 18 feet or so. In order that trawler nets do not snag on such trees, expensive protection structures or well reinforcing may be required to be installed around each tree. However, the present invention provides a christmas tree including a valve assembly comprising one or more valves installed at a well-head to control the flow of produce thereat, at least one of the one or more valves being retained within an outlet of the well-head.

12 Claims, 5 Drawing Sheets

WELL-HEAD STRUCTURES

BACKGROUND OF THE INVENTION

This invention relates to well-head structures and particularly to so-called christmas trees, i.e. the complex of valves and pipes installed at a well-head to control the flow of high pressure oil or gas. The invention more particularly, but not exclusively relates to such structures for use in sub-sea structures.

PRIOR ART

A prior art sub-sea christmas tree is shown in FIG. 1 herein. The prior art christmas tree, generally designated 5, comprises a valve assembly 10 providing a plurality of valves 15 located above the level of the sea-bed 20. The valves 15 are normally manual or hydraulic gate valves.

The valve assembly 10 is located above a well-head tube 25 having a tubing hanger 26 comprising a plurality of concentric tubes 30 contained therein. The well-head tube 25 is itself contained within a conductor 24.

The assembly 10 is retained in its location by means of a mechanical connector 35 having an internal through-aperture 40 suitable for accepting a lower end of the valve assembly 10. To lock the valve assembly 10 in place, loaded collet fingers 45 provided on the outer surface of the lower end of the valve assembly 15 locate within corresponding recesses 50*a* in the aperture 40 wall. An upper end of the well-head tube 25 is further retained within the aperture 40 by an inner surface of the collet fingers 45 engaging with a corresponding recess 50*b* in the upper end of the well-head tube 25.

Within the well-head tube 25 and tubing hanger 26 there is provided a conduit 55 for containment of the main production flow, the lower end of the conduit 55 extending into a production borehole in the sea-bed 20 (not shown), while the upper end of the conduit 55 is suitably connected to the lower end of the valve assembly 10 within the aperture 40.

Extending from an outlet of the valve assembly 10 there is a flow loop 60 which is suitably shaped to withstand cyclic stresses. A choke 65 is provided in the flow loop 60, the choke 65 serving to control the velocity of fluid therethrough.

At an upper end of the valve assembly 10 of the christmas tree 5 there is provided a tree cap 70 which is supported by the tree 5 and a safety frame located therearound (not shown). Further, the tree cap 70 has a through-aperture 71 located substantially centrally thereupon. A lower end of a further assembly, generally designated 75, may extend downwardly into the through-aperture 71 and collet (or claw) fingers 76 located around the lower end of the assembly 75 locate within a corresponding recess 80 in the upper end of the valve assembly 10 which extends upwardly into the tree cap aperture 71. Plugs or valves must be set in the tree cap 70 to prevent oil/gas escaping into the environment. In addition, a weight set cap is employed as a back-up to the plugs/valves in tree cap 70.

Spaced substantially equidistant around the tree 5 are a plurality (normally four) of guide rods 85, the upper ends of which are engageable with lower ends of an equal number of mating rods (not shown) retained in association with the further assembly 75. The guide rods 85 are connected to the conductor 24 via a guidebase 84.

A yet further assembly (not shown) such as a supplementary christmas tree may be provided for safety reasons in the event of failure of the christmas tree 5. The upper end of the further assembly 75 is connectable via stress joints (not shown) to a semi-submersible rig or similar vessel.

Presently known sub-sea christmas trees, such as that described above, suffer from a number of problems. In particular, in order to accommodate all the required valves and pipes known trees are normally undesirably high—ie. of the order of 18 feet or so. In order that trawler nets do not snag on such trees, expensive protection structures or well reinforcing may be required to be installed around each tree.

OBJECTS OF THE PRESENT INVENTION

It is an object of the present invention to obviate or mitigate the aforementioned problems in the prior art.

SUMMARY OF THE PRESENT INVENTION

According to a first aspect of the present invention, there is provided a christmas tree providing a valve assembly comprising one or more valves installed at a well-head to control the flow of produce thereat, at least one of said one or more valves being retained within an outlet of said well-head.

Normally the outlet of the well-head will have a well-head tube extending inwardly therefrom, the at least one valve being retained within said well-head tube.

Further, a tubing hanger may be provided at or near an inwardly extending end of the well-head tube.

Where the christmas tree is provided substantially on the surface of the sub-sea, the well-head tube may be located substantially under the sea-bed, an outwardly extending end of the conductor tube being located above sea-bed level, such that said at least one valve is provided below sea-bed level.

The at least one valve is preferably a ball valve, and may be a ball cutter valve.

Preferably also, the at least one valve is controlled by hydraulic pressure.

An outermost end of the valve assembly is preferably connectable to a further assembly which may comprise a "y" or "t" spool, flow valve, choke and control module.

According to a second aspect of the present invention, there is provided a method of controlling flow from a sub-sea well-head comprising locating a christmas tree substantially below the sub-sea level, within a well-head tube having an outlet extending above sea-bed level.

BRIEF DESCRIPTION OF THE DRAWINGS

An embodiment of the present invention will now be described, by way of example only, with reference to the accompanying drawings which are.

DETAILED DESCRIPTION OF THE DRAWINGS

Figure 1:
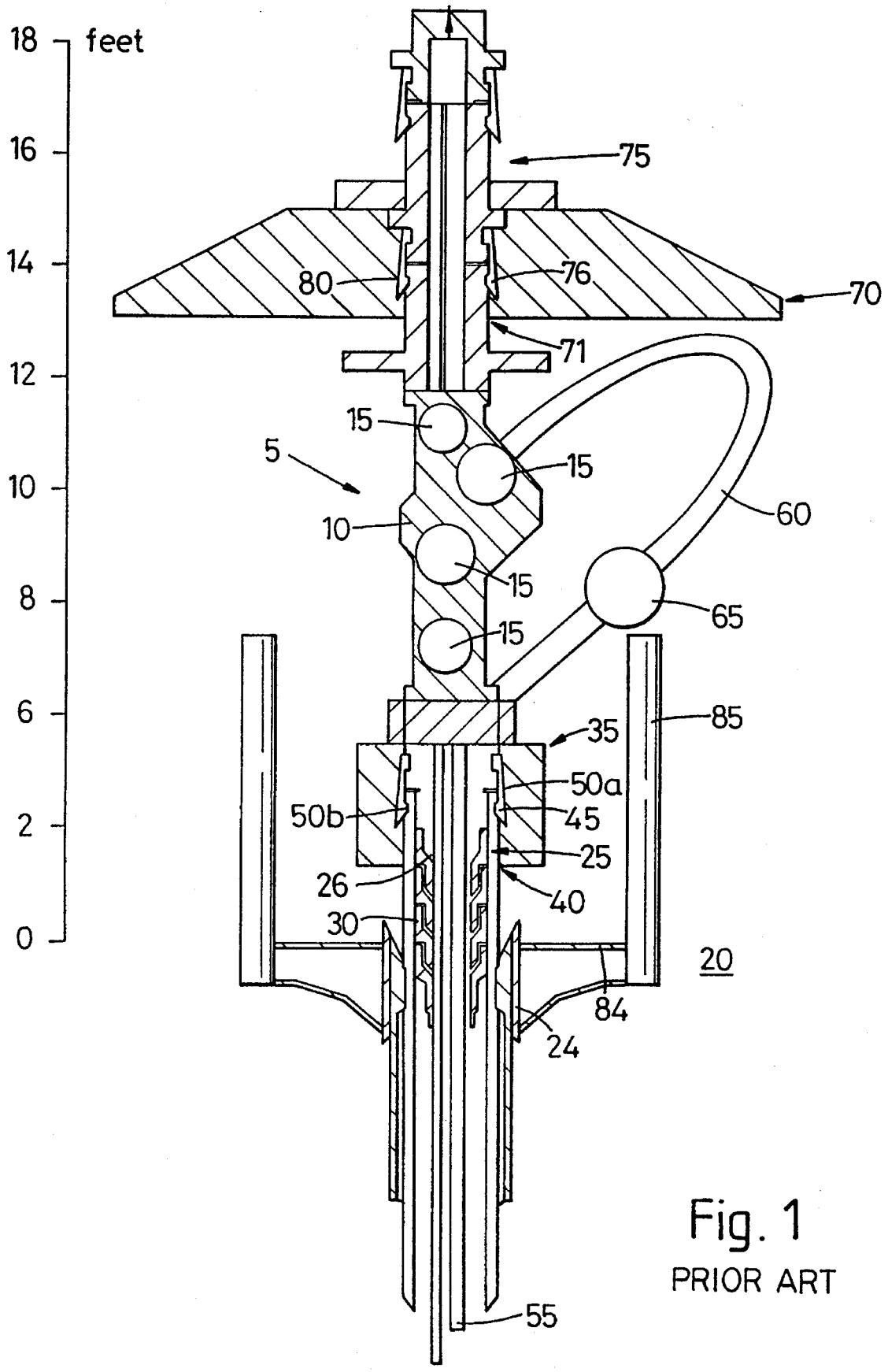
Fig. 1 PRIOR ART
FIG. 1 a side view of an embodiment of a sub-sea christmas tree according to the prior art.
Figure 2:
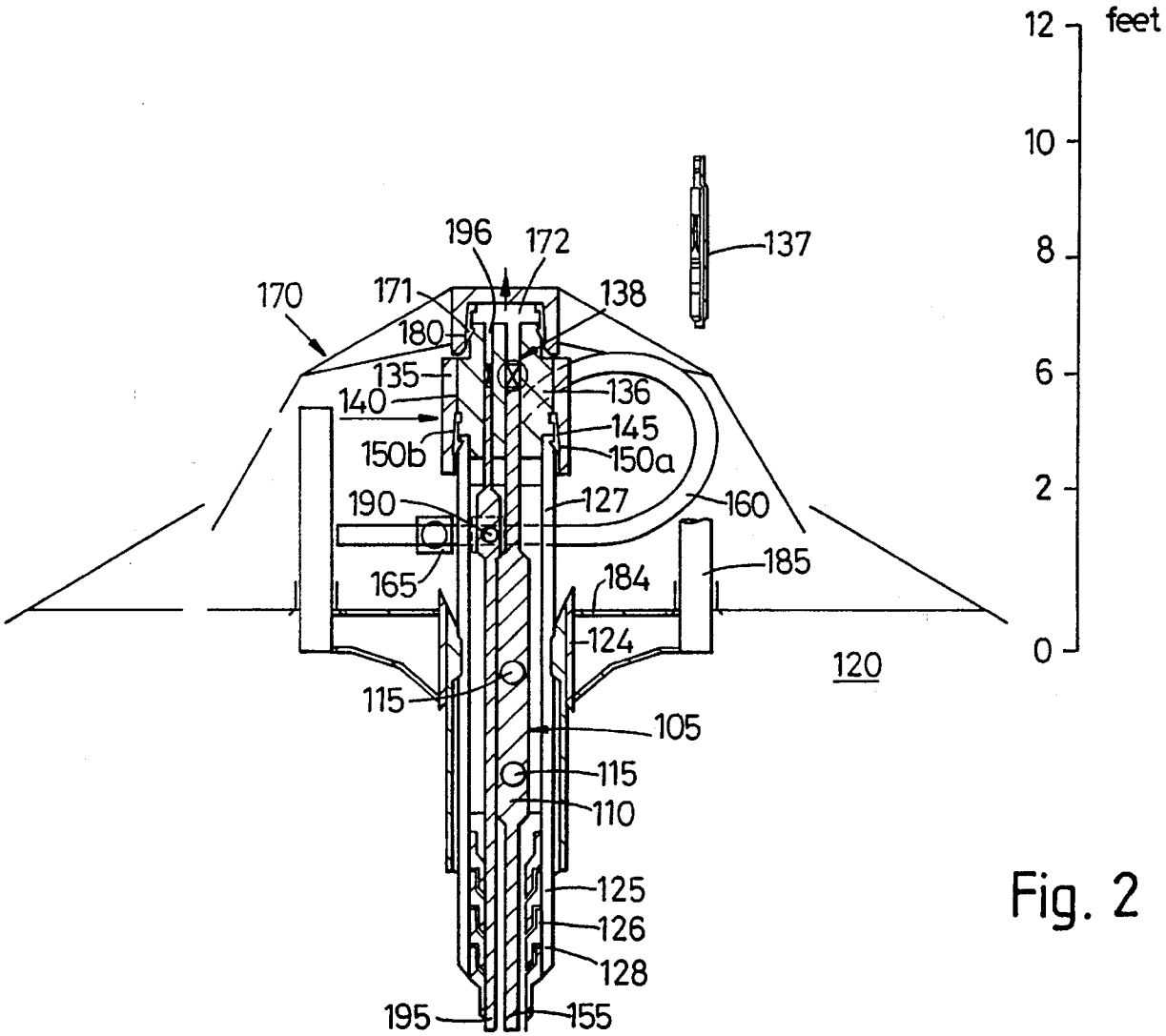
FIG. 2 a side view of an embodiment of a sub-sea christmas tree according to the present invention.

Referring to FIG. 2, there is provided an embodiment of a christmas tree, generally designated 105, according to the present invention located substantially at sea-bed level. The christmas tree 105 comprises a valve assembly 110 providing a plurality of valves 115 located below the level of the sea-bed 120. In this embodiment, the valves 115 are ball cutter valves as hereinafter described.

The valve assembly 110 is located within a well-head tube 125 having a first, upper end 127 which extends above the surface of the sea-bed 120 outwardly from a conductor borehole (not shown), and a second, lower end 128 which extends inwardly of the conductor borehole. The well-head tube 125 is itself contained within a conductor guidebase 124.

At the lower end 128 of the well-head tube 125 there is provided a tubing hanger 126 as is known in the art. A pack-off may be positioned at the upper or lower end of the well-head tube 125. The upper end 127 of the conductor tube 125 has a recess **150*a* spaced therearound. This recess 150*a* is capable of receiving an inner surface of each of a corresponding plurality of collet fingers 145 provided on an upper package 136. Further, an outer surface of each of the plurality of collet fingers 145 are capable of being supplied within corresponding recesses 150*b* in an inner surface of an aperture 140 of a mechanical connector 135**.

In this way, the well-head tube 125, upper package 136 and mechanical connector 135 may be retained together.

The upper package 136 consists of a flow spool or similar flow wing valve, flow wing valve, choke, and control module. This package 136 directs the flow and the control of the tree 105 to a platform above.

An upper end of the valve assembly 110 is contained within the upper package 136, and a metal-to-metal sealing wireline plug 137, or similar, may be run into a first upper bore 138 in a top surface of the upper package to seal the bore 138.

Within the well-head tube 125 and tubing hanger 126 there is provided a conduit 155 for containment of the main production flow, the lower end of the conduit 155 extending into the production borehole in the sea-bed 120, while the upper end of the conduit 155 is connected to the lower end of the valve assembly 110 within the well-head tube 125.

Extending from an outlet of the upper assembly 136 there is a flow loop 160 which is suitably shaped to withstand cyclic stresses. A choke 165 is provided in the flow loop 160, the choke serving to control the velocity of fluid therethrough.

At an upper end of the upper assembly 136 there is provided a debris cover 170 which is supported by the upper assembly 136 and a safety frame located therearound (not shown). The cover 170 is connectable to the upper end of the upper assembly 136 via collet fingers 171 provided on an inner surface of an aperture 172 in the cover 170, the collet fingers 171 being receivable in a corresponding recess 180 in an outer surface of the upper end of the upper assembly 136. This cover also acts as a secondary metal-to-metal seal against the environment.

Spaced substantially equidistant around the tree 105 and connected to the conductor 124 via a guidebase 184 are a plurality of guide rods 185, the upper ends of which are engageable with lower ends of an equal number of mating rods (not shown) retained in association with a further assembly 175.

A further assembly (not shown) may be a supplementary christmas tree provided for safety reasons in the event of failure of the tree 105. The further assembly may be supported by a semi-submersible rig or floating platform.

A further valve 190 is provided within the tube 125, a lower end of this valve 190 being connected to a further conduit 195 extending into the borehole through the well-head tube 125 and tubing hanger 126, while an upper end of the valve 190 is connected to the upper assembly 136 communicating with a bore 196. The further valve 190 is preferably also a ball cutter valve. The function of the further valve 190 and conduit 195 is to act as an anualis pressure control valve, as is known in the art.

Figure 3:
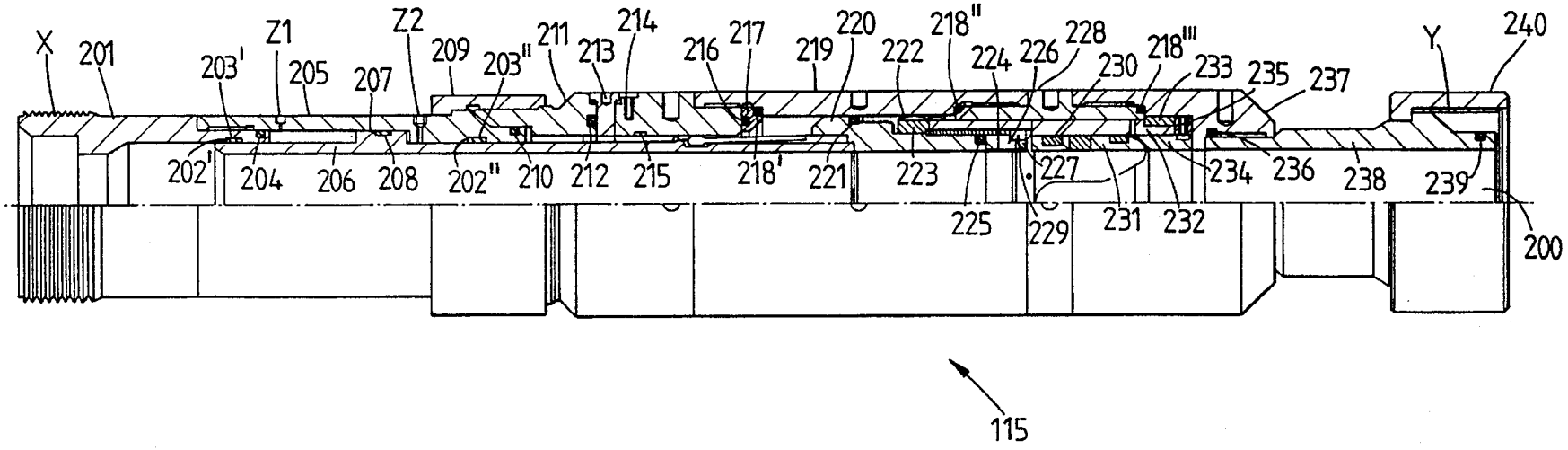
FIG. 3 a side partial cross-sectional view to an enlarged scale of a valve for use in the christmas tree of FIG. 2.
Figure 4:
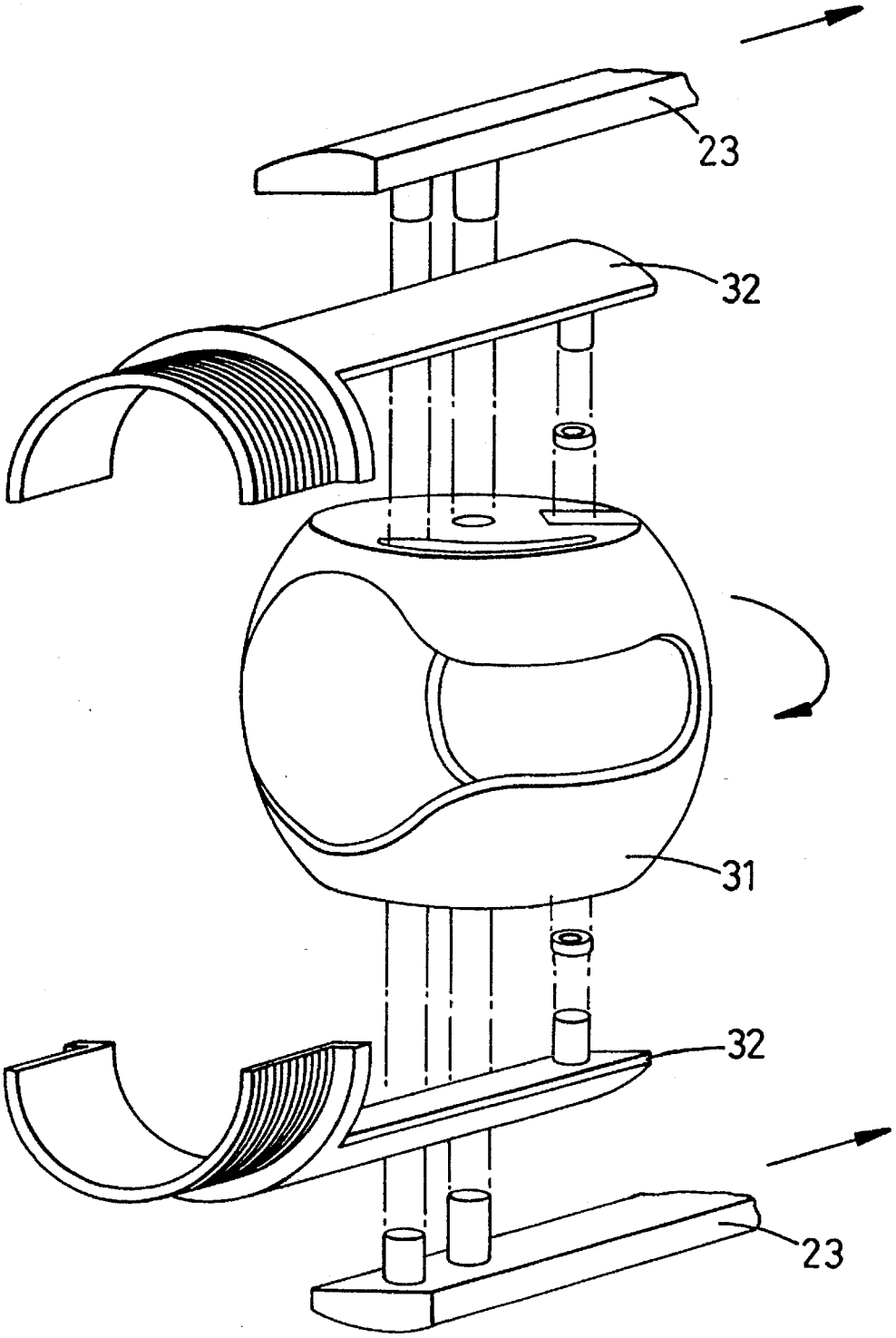
FIG. 4 a perspective exploded view to an enlarged scale of a ball and pivot arm assembly for use in the valve of FIG. 3.

Referring to FIGS. 3 and 4 there is provided a valve, generally designated 115 for use in the Christmas tree 105 of FIG. 2. The valve 115 is a ball cutter valve and comprises a flow orifice 200, an upper connector 201, first T-seal back-up 202, first T-seal 203, first o-ring 204, hydraulic chamber 205, actuating piston 206, second T-seal back-up 207, second T-seal 208, quick release collar 209, third T-seal back-up 202, third T-seal 203, second o-ring 210, position indicator housing 211, third o-ring 212, TLC indicator screw 213, TLC limit screw 214, latch 215, fourth o-ring 216, equalising hard seat 217, fifth o-ring 218, choke housing 219, choke 220, wiper-ring 221, pivot arm retainer 222, set pivot arms 223, upper cutter plate 224, sixth o-ring 225, ball seat sub-assembly 226, bore cutter plate 227, ball housing 228, hexagonal socket set screw 229, pivot sleeve 230, cutter ball 231, set ball control arms 232, control arm retainer 233, support ring 234, hexagonal socket set screw 235, seventh o-ring 236, control arm retainers housing 237, lower connector 238, eight o-ring 239, and a quick union collar 240, also comprising a first connector X at a first, upper end of the valve and a second connector Y at a second, lower end of the valve 115. Communicating with the hydraulic chamber 5 at upper and lower end thereof are two hydraulic inlet ports Z1 and Z2.

Referring to FIG. 2 the ball cutter valve 115 is shown in a closed position, wherein hydraulic pressure is applied to the hydraulic chamber 5 via inlet port Z1 thereby moving actuating piston 6 in a downward direction. This causes consequential downward movement of the set pivot arms 23 and cutter ball 31. Downward movement of the cutter ball 31 acting against the action of ball control arms 32 causes the cutter ball 31 to rotate into a closed position thereby closing the flow oriface 200 through the valve 115.

To open the valve 115, hydraulic pressure may be applied to the hydraulic chamber 5 via inlet port z2 thereby causing the annular piston 206 to move in an upward direction. The upward movement of the piston 206 causes consequential upward movement of the pivot arms 23 and cutter ball 31. This has the consequential effect of rotating the ball 31 against the action of the ball control arms 32.

Figure 5:
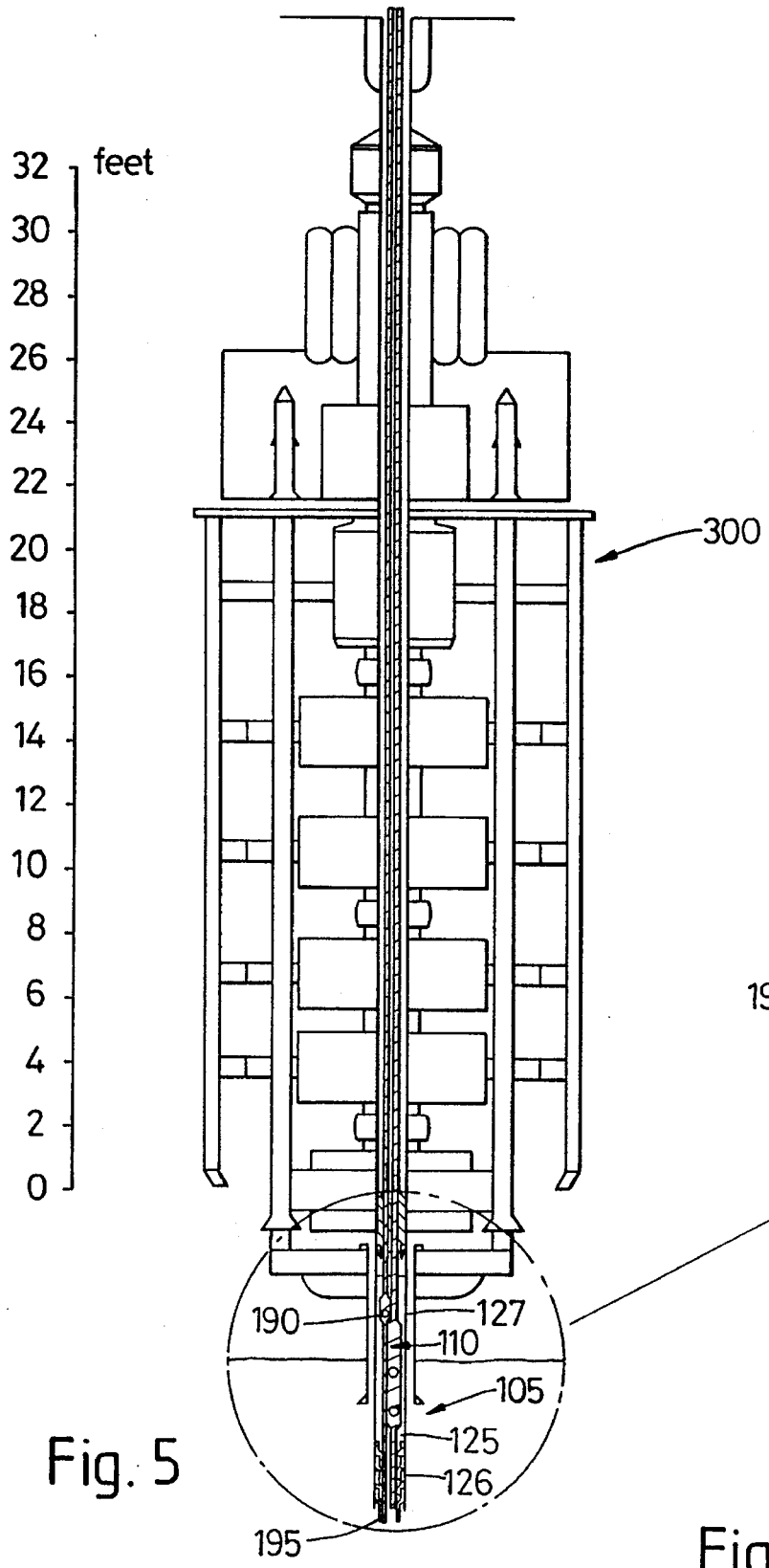
FIG. 5 a side view to a reduced scale of the christmas tree of FIG. 2 with a well-head structure attached thereabove.
Figure 6:
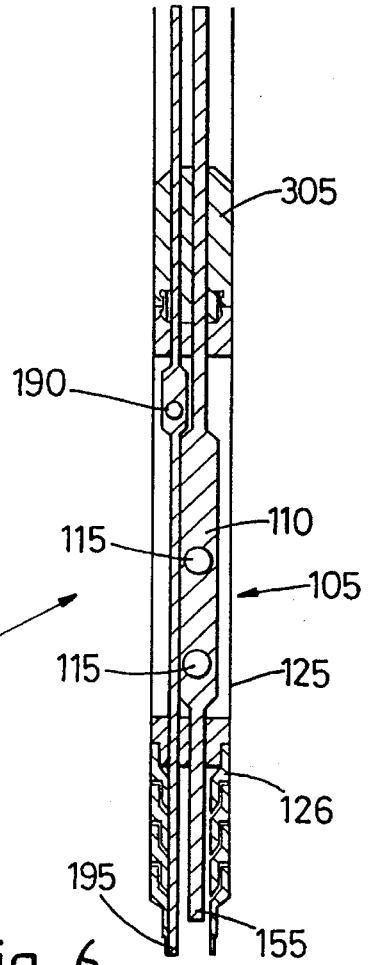
FIG. 6 an enlarged side view of the christmas tree shown in FIG. 5.

Referring to FIGS. 5 and 6, for the purpose of production testing the well, there is illustrated the christmas tree 105 hereinbefore described, the upper end 127 of the tree 105 being connected to a semi-submersible rig 300 via an emergency disconnect facility 305.

Installation of the tree 105 requires that the conductor 125 be installed within the conductor guide base 124. The well-head tube 125 is typically 18" in diameter, while the conductor guidebase is 30" in diameter. A BOP is then installed following conventional procedures, and a well borehole drilled.

It should be noted that a special protection sleeve may be provided in order to protect the inner diameter of the well-head tube 125.

When the well borehole has been drilled the tubing hanger 126 may be placed at the lower end 128 of the well-head tube 125. In this way a void of approximately 18" diameter is left between the upper end of the tubing hanger 126 and the upper end 127 of the well-head tube 125. This void can therefore be used to house the valve assembly 110, further valve 190, and tubing hanger 126, and any other x-over or injection valves.

It should be understood that the embodiment of the invention hereinbefore disclosed is given by way of example only, and is not meant to limit the scope of the invention in any way. It should be particularly noted that although the disclosed embodiment employs ball cutter valves, any suitable ball valve may be used, or alternatively suitable flapper type valves, or indeed a combination of suitable types of valves may be employed. Also, some or all of the valves may be of a cutter type, able to cut, eg. 1.5" tubing or electric wireline.

It should also be appreciated that a christmas tree according to the present invention has a number of operational and cost advantages, eg. lower height above the sea-bed, enhanced safety due to the valve assembly being protected by the conductor, reduced weight, lower manufacturing costs, and ease of installation.

We claim:

1. A Christmas tree which in use is provided on a geophysical surface and installed at a well-head to control the flow of produce at the well-head, said Christmas tree comprising:

a valve assembly including at least one valve;

a well-head tube at least partially located below the geophysical surface; and retaining means for retaining said at least one valve of said valve assembly within said well-head tube below the geophysical surface.

2. The Christmas tree as claimed in claim 1, wherein the geophysical surface is the sea-bed.

3. The Christmas tree as claimed in claim 1, further comprising a tubing hanger, and wherein said well-head tube has an inwardly extending end, said tubing hanger being provided at or near said inwardly extending end of said well-head tube.

4. The Christmas tree as claimed in claim 2, further comprising a tubing hanger, and wherein said well-head tube has an inwardly extending end, said tubing hanger being provided at or near said inwardly extending end of said well-head tube.

5. The Christmas tree as claimed in claim 1, wherein said well-head tube has an outwardly extending end located above the geophysical surface.

6. The Christmas tree as claimed in claim 2, wherein said well-head tube has an outwardly extending end located above the geophysical surface.

7. The Christmas tree as claimed in claim 3, wherein said well-head tube has an outwardly extending end located above the geophysical surface.

8. The Christmas tree as claimed in claim 1, wherein said at least one valve is a ball valve.

9. The Christmas tree as claimed in claim 1, wherein said at least one valve is a ball cutter valve.

10. The Christmas tree as claimed in claim 1, wherein said at least one valve is controlled by hydraulic pressure.

11. The Christmas tree as claimed in claim 1, wherein said valve assembly has an outermost end, said Christmas tree further comprising a further assembly which is connected to one of the following: a "y" spool, a "t" spool, a flow valve, and a choke and control module; and connection means for connecting said outermost end of said valve assembly to said further assembly.

12. A method of controlling production flow from a well-head, comprising the steps of:

providing a well-head tube which is at least partially located below a geophysical surface;

locating a Christmas tree on the geophysical surface at the well-head, the Christmas tree including a valve assembly comprising at least one valve;

retaining at least one valve of the valve assembly within the well-head tube below the geophysical surface using retaining means; and controlling at least one valve of the valve assembly so as to control the flow of produce from the well-head.

* * * * *